US005540171A

United States Patent [19]

Monahan

[11] Patent Number: 5,540,171

[45] Date of Patent: Jul. 30, 1996

[54] SLIDER ASSEMBLY FOR SAILING VESSEL

[75] Inventor: J. Kevin Monahan, Delafield, Wis.

[73] Assignee: Harken, Inc., Pewaukee, Wis.

[21] Appl. No.: 489,216

[22] Filed: Jun. 12, 1995

[51] Int. Cl.[6] ..... B63H 9/08

[52] U.S. Cl. ..... 114/204; 114/112

[58] Field of Search ..... 16/87 R, 96 R, 16/88–92, 93 R, 94 R, 95 R, 97, 107; 119/784; 105/154; 114/39.1, 102, 103, 112, 89, 204, 90, 108, 205; 104/95, 107, 244, 247

[56] References Cited

U.S. PATENT DOCUMENTS 591,446 10/1897 Worthen ..... 114/112

4,080,919 3/1978 Holland et al. ..... 114/112

FOREIGN PATENT DOCUMENTS 979339 1/1965 United Kingdom ..... 114/204

*Primary Examiner*—Edwin L. Swinehart

*Attorney, Agent, or Firm*—Juettner Pyle Lloyd & Piontek

[57] ABSTRACT

A slider assembly useful as a working part on a sailing vessel includes a track and a slider mounted on the track. The slider includes a pair of U-shaped end pieces held in a spaced relationship by side pins and a central pin. Tubular bushings are mounted on the side pins and in sliding engagement with the grooves of the track.

8 Claims, 1 Drawing Sheet

SLIDER ASSEMBLY FOR SAILING VESSEL

BACKGROUND OF THE INVENTION

This invention relates to a slider, which is a device movable along a track to various positions and is used to provide support for an object, such as a portion of a sail or control lines for a sail on a sailboat.

Many sailing vessels are equipped with tracks made from extruded aluminum or other metal and affixed to the mast or the deck. The tracks have opposed longitudinal grooves or channels in the sides, and a car or slider is mounted on the track and has beating parts which embrace and engage in the opposed grooves and prevent the car or slider from lifting off the track while being movable thereon.

Sliders are used for a variety of purposes on sailing vessels and are available in various configurations. For example, a track may be secured to the back of the mast. A plurality of sliders may be provided on the track and connected at spaced locations to the luff of the mainsail or to battens for the sail. Sliders may be also mounted on tracks affixed to the deck in order to support a working part, such as a block, in a variety of positions.

SUMMARY OF THE INVENTION

The slides of the present invention comprises a pair of spaced support arms having a V or U shape. The arms or plates extend across the track and have ends adjacent the side grooves in the track. A pair of elongate cylindrical bushings are connected between the ends of the two arms and slidably engage in the track grooves. The central apex of the arms are spaced from the track, and a third bushing or other fitting is connected between the arms at the apex, to define an open structure. The third bushing or other fitting is adapted to be connected to another object, such as a sail.

In use, the cylindrical outer bushings function as slider bearings in the grooves of the track. Loads imposed on the central connecting portion are transferred through the end plates and outer bushings to the supported track. A major advantage of the present slider is that all functional components are integrated in an open framework, and the slider is very light in weight compared to other known sliders of this type.

DESCRIPTION OF THE PREFERRED EMBODIMENTS

Figure 1:
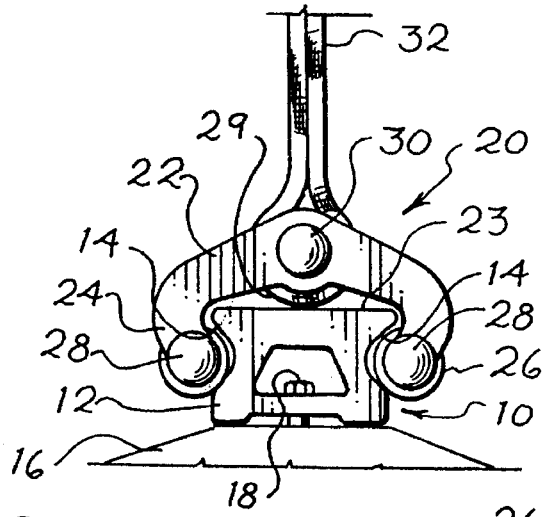
FIG. 1 is an end view of the slider of the present invention, shown in combination with a track.
Figure 2:
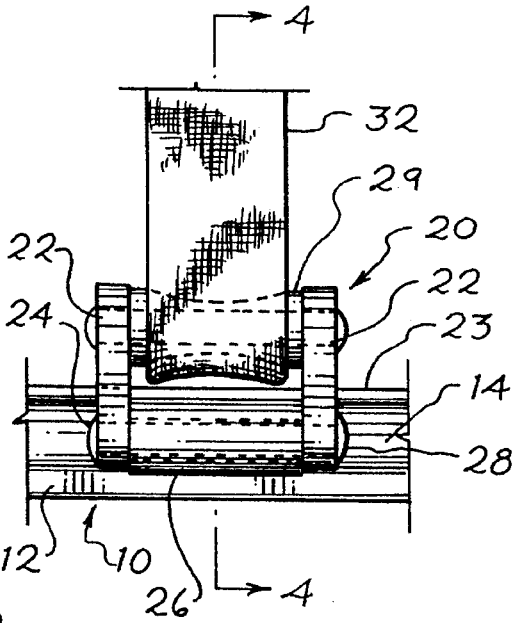
FIG. 2 is a side view of the assembly shown in FIG. 1.
Figure 3:
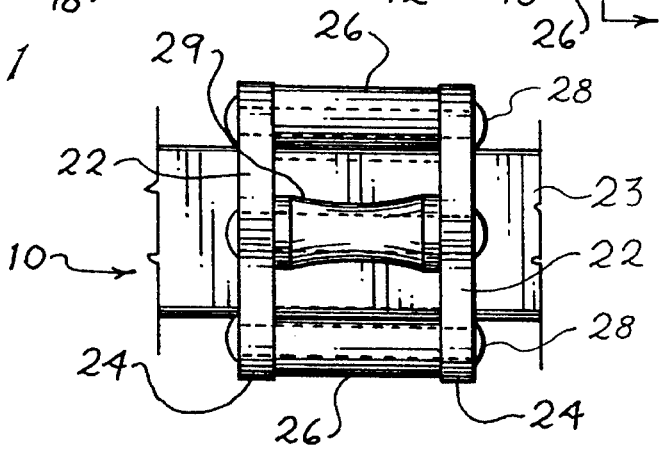
FIG. 3 is a top view of the assembly shown in FIG. 1.

As shown in FIGS. 1–4, the slider of the present invention is mounted in a slidably engaged relationship with a track 10, which is substantially rectangular in cross section. The track 10 includes a pair of spaced side walls 12 each having a longitudinal groove 14 of arcuate cross section therein. The track 10 is adapted to be secured to a relatively fixed support, such as the aft portion of a mast 16 (FIG. 1) by means of bolts 18 or the like.

The slider 20 comprises a pair of spaced end plates 22 which are generally U-shaped. The plates 22, in the final assembly, extend across the top wall 23 of the track 10 and terminate at each end at inwardly curved arms 24 opposite the grooves 14 in the track, with all portions of the plates being spaced from the track.

The ends of the arms 24 of the two plates 22 are connected and held in a spaced relationship by a pair of pins 28, which carry a pair of bearing elements or bushings 26. The bushings 26 are rotatably mounted on the pins 28 which extend through and are secured in aligned openings in the ends of the arms 24. The diameter of the bushings is larger than the rounded ends of the arms. In the final assembly, the bushings 26 serve as bearing elements and engage the respective grooves 14 of the track 50 as to confine the slider to longitudinal movement along the track only, with the slider being incapable of being moved in any direction other than longitudinally along the track.

The length of the bushings 26 is preferably sufficiently long, taking account of acceptable tolerances, to prevent excessive rocking of the slider on the track. The bushings may be made from a high strength plastic or composite material, and the material preferably selected from one having a low coefficient of friction in its finished form.

The central portions of the plates are spaced away from the top wall 23 of the track 10, and these portions are connected together by any suitable means to enable the slider to be attached to another part or object. In the embodiments shown in FIGS. 1–4, the means may comprise a third pin 30 connected between aligned openings in a central portion of the plates, with a third bushing 29 rotatably mounted on the pin. The axes of the three bushings are preferably parallel and define the comers of an equilateral triangle.

Preferably, the pins 28 and 30 are secured to the plates 20 and serve to hold the plates in a spaced relationship, with the bushings 26 and 28 being loosely and rotatably mounted on the pins between the plates. This minimizes frictional wear on the bushings, which would be subject to wear in limited areas if they were held in a fixed position.

The central bushing 28 may have an hourglass shape to facilitate the support of a strip 32 of heavy fabric or webbing. The strip 32 is looped around the bushing 28 and is connected to another part or object spaced from the slider. In the embodiment shown, the webbing embraces opposite sides of a leading edge 33 (FIG. 4) of a sail and may be sewn or otherwise secured thereto. The hourglass shape tends to center the strip 32 in the bushing. Obviously, the central bushing 28 may be replaced by any suitable attachment or connection means, such as an attachment post, an eyelet or loop, or a working part such as a block.

Figure 4:
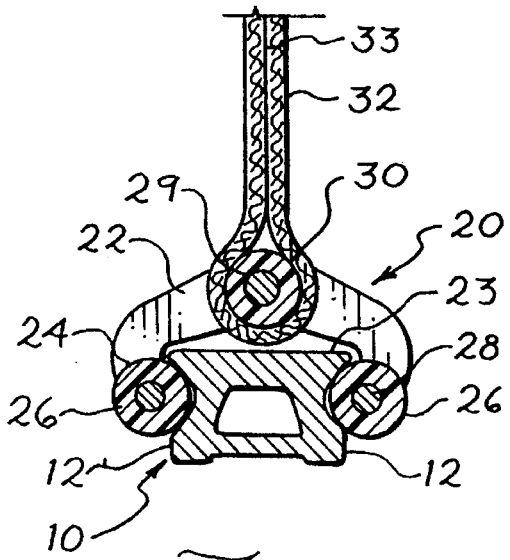
FIG. 4 is a sectional view taken along line 4—4 of FIG. 2.
Figure 5:
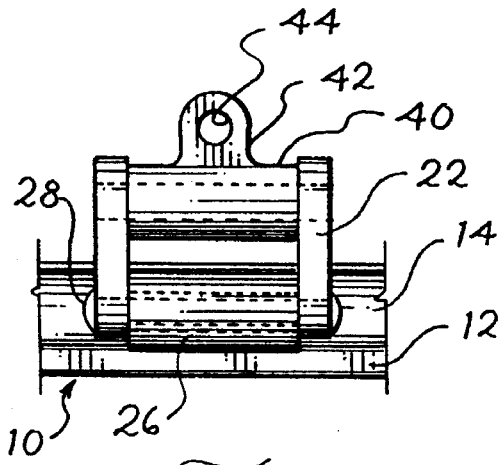
FIG. 5 is a side view of another embodiment of the present invention.

FIG. 4 shows the replacement of the central bushing with a sleeve 40 having a central ear 42 with an eyelet 44 formed therein to enable the attachment of another working part, such as a block.

Unlike previously known sliders or cars of this general nature, which comprise a solid body having shoulders and inwardly projecting bearings, the slider of the present invention is in the form of an open triangular prism, with the structure and functional parts defining the outline of the prism.

What is claimed is:

1. A slider assembly comprising an elongate track having a top and sides and longitudinal grooves in the sides; and a slider slidably mounted on said track, said slider comprising a pair of spaced end plates extending across said track and having arms adjacent said grooves, a pair of tubular bushings mounted between the arms of the respective plates, said bushings being slidably engaged in said grooves, and mounting means connected between a central portion of said spaced end plates for connecting said slider to another object.

2. The slider assembly of claim 1 additionally comprising connection means for holding said end plates in a spaced relationship.

3. The slider assembly of claim 2 wherein said connection means comprises a pair of pins secured between said arms, with said tubular bushings mounted on said arms.

4. The slider assembly of claim 3 wherein said tubular bushings are rotatably mounted on said arms.

5. The slider assembly of claim 1 wherein said mounting means comprises a pin extending between a central portion of said spaced end plates.

6. The slider assembly of claim 5 wherein said mounting means comprises a bushing around said pin.

7. The slider assembly of claim 5 wherein said mounting means comprises a fitting mounted on said pin.

8. A slider assembly comprising an elongate track comprising a top and sides and longitudinal grooves in the sides, and a slider slidably mounted on said track, said slider comprising a pair of spaced substantially U-shaped end plates each having a pair of ends, pins connected between corresponding ends of said plates and between a central portion thereof to define an open prismatic structure, and a pair of tubular bushings mounted on the pins between the ends of the side plates, said bushings being slidably engaged in said grooves with said end plates spaced from said track.

* * * * *